US010624811B2

(12) United States Patent
Mackey-Ponte

(10) Patent No.: US 10,624,811 B2
(45) Date of Patent: Apr. 21, 2020

(54) VIBRATING HAND BAND

(71) Applicant: Adreama Mackey-Ponte, Floral Park, NY (US)

(72) Inventor: Adreama Mackey-Ponte, Floral Park, NY (US)

( * ) Notice: Subject to any disclaimer, the term of this patent is extended or adjusted under 35 U.S.C. 154(b) by 491 days.

(21) Appl. No.: 14/601,413

(22) Filed: Jan. 21, 2015

(65) Prior Publication Data

US 2015/0209222 A1 Jul. 30, 2015

Related U.S. Application Data

(60) Provisional application No. 61/931,822, filed on Jan. 27, 2014.

(51) Int. Cl.

| | |
|---|---|
| ***A61H 23/00*** | (2006.01) |
| ***A61H 23/02*** | (2006.01) |
| ***A61H 11/00*** | (2006.01) |

(52) U.S. Cl.

CPC ..... *A61H 23/02* (2013.01); *A61H 11/00* (2013.01); *A61H 2201/0207* (2013.01); *A61H 2201/165* (2013.01); *A61H 2201/1635* (2013.01)

(58) Field of Classification Search

CPC .. A61H 23/02; A61H 11/00; A61H 2011/005; A61H 2201/165; A61H 2201/1635; A61H 2201/0207; A61H 15/0085; A61H 15/0092; A61H 15/02; A61H 2205/065

See application file for complete search history.

(56) References Cited

U.S. PATENT DOCUMENTS

| | | | | |
|---|---|---|---|---|
| 3,710,784 | A * | 1/1973 | Taylor | A61H 23/0263 219/212 |
| 5,534,021 | A * | 7/1996 | Dvoretzky | A61F 7/02 126/204 |
| 5,925,002 | A * | 7/1999 | Wollman | A61H 23/0263 601/46 |
| 7,022,093 | B2 * | 4/2006 | Smith | A61F 5/0106 602/14 |
| 7,503,927 | B1 * | 3/2009 | Vetanze | A61N 1/0408 607/115 |
| 7,693,580 | B2 * | 4/2010 | Docherty | A61F 7/007 607/100 |
| 8,002,721 | B2 * | 8/2011 | Bretl | A61F 7/02 602/2 |
| 8,641,745 | B2 * | 2/2014 | Warner | A61F 7/02 607/111 |
| 9,775,769 | B2 * | 10/2017 | Brown | A61H 23/02 |
| 2002/0169398 | A1 * | 11/2002 | Hancock | A61F 7/007 601/15 |
| 2004/0143199 | A1 * | 7/2004 | Cotterell-Grant | A61H 23/008 601/15 |
| 2005/0143679 | A1 * | 6/2005 | Gelber | A61H 7/005 601/15 |

(Continued)

*Primary Examiner* — Steven O Douglas

(74) *Attorney, Agent, or Firm* — New York Law School PPC

(57) ABSTRACT

A vibrating hand band is provided, comprising a closed loop strap of a stretchable material dimensioned to encircle a user's hand, a pad secured to a portion of the strap, a vibrating mechanism embedded in the pad, and a power supply to provide power to the vibrating mechanism.

16 Claims, 5 Drawing Sheets

(56) References Cited

U.S. PATENT DOCUMENTS

2007/0255187 A1* 11/2007 Branch ..... A61F 7/02
601/15
2011/0106227 A1* 5/2011 Desiderio ..... A61F 7/02
607/111

* cited by examiner

VIBRATING HAND BAND

RELATED APPLICATION DATA

The present application is related to and claims the benefit of commonly-owned and U.S. Provisional Patent Application Ser. No. 61/931,822 entitled MOTHER'S TOUCH and filed on Jan. 27, 2014, which application is incorporated herein by reference in its entirety.

TECHNICAL FIELD

The present invention relates generally to baby care products.

BACKGROUND ART

When a baby is tired, but is unable to fall asleep, the baby may become restless and begin to cry. As a result, parents and guardians may spend a considerable amount of time attempting to pacify the baby and lull the baby to sleep. Parents and guardians often try to lull a baby to sleep by rocking the baby in a rocking chair, or placing the baby in a swing or a bouncer. However, these devices are too large to be carried or used during travel, and are not easily transported to different locations within a home and do not offer the personal comfort and closeness of being held by a parent.

SUMMARY OF THE INVENTION

The present invention provides a vibrating hand band, comprising a closed loop strap of a stretchable material dimensioned to encircle a user's hand, a pad secured to a portion of the strap, a vibrating mechanism embedded in a pad, and a power supply to provide power to the vibrating mechanism.

DETAILED DESCRIPTION OF THE PREFERRED EMBODIMENT

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
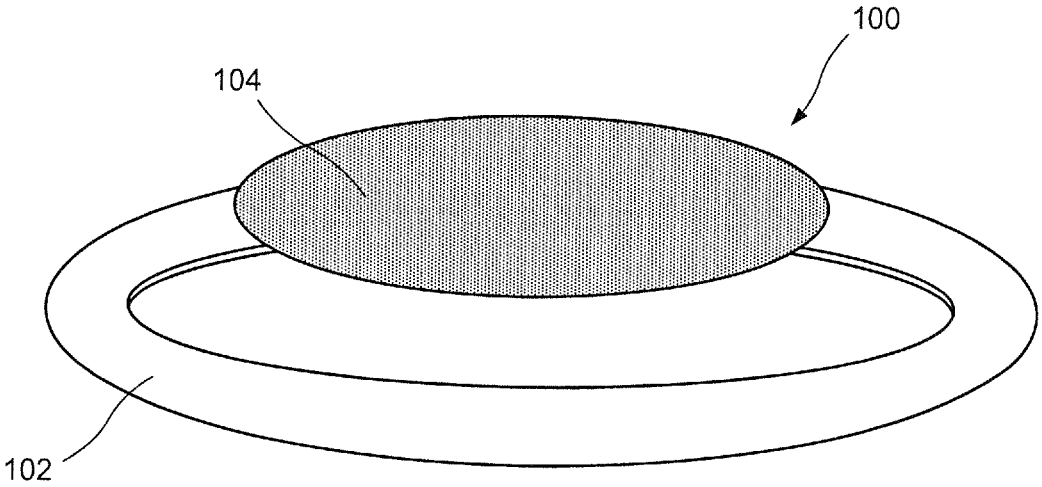
FIG. 1 illustrates an embodiment of a vibrating hand band of the present invention.
Figure 2:
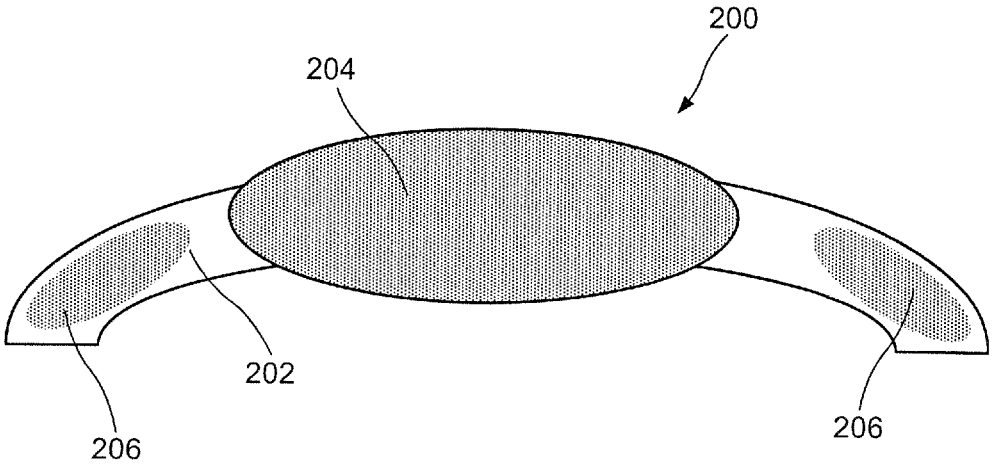
FIG. 2 illustrates another embodiment of a vibrating hand band of the present invention.
Figure 3:
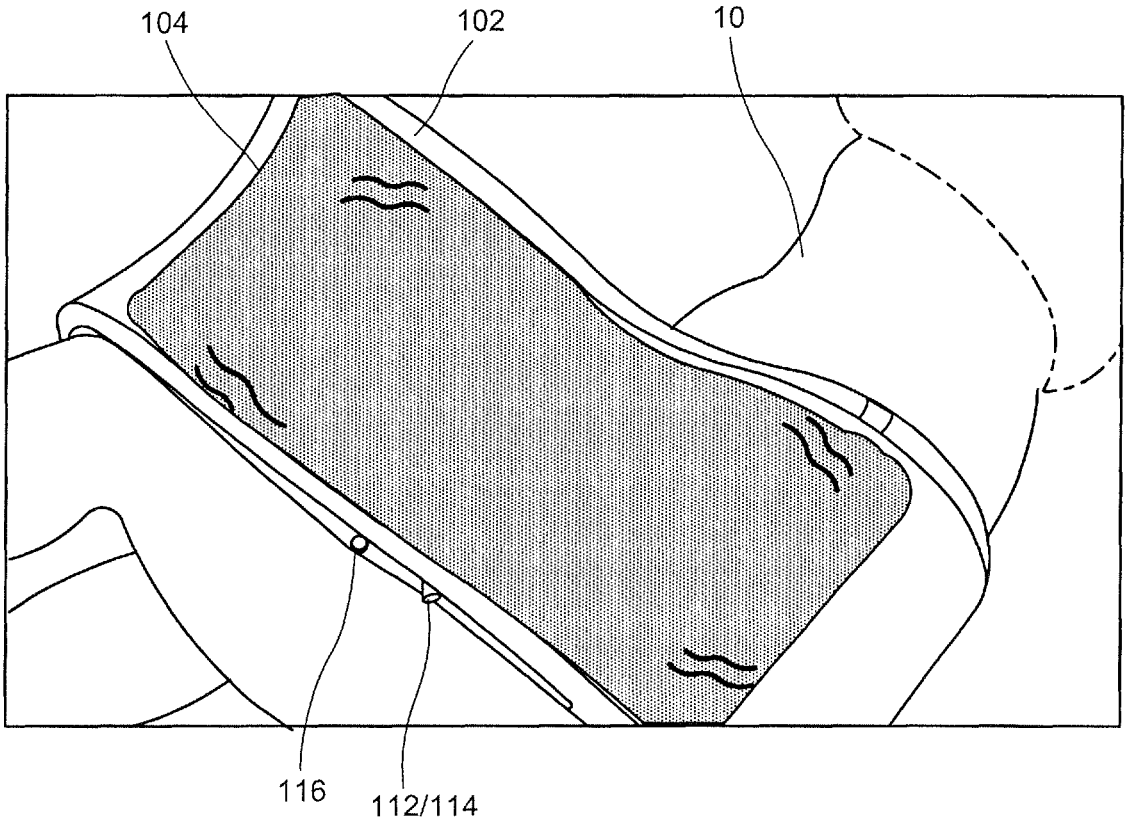
FIG. 3 Illustrates a view of the palm-side of the vibrating hand band of the present invention of FIG. 1 or FIG. 2.

FIG. 1 illustrates an embodiment of a vibrating hand band 100. The band 100 may include a strap 102 that, about 1 inch to about 1½ inches wide, and an oval-shaped pad 104 about 2 inches wide. The strap 102 may be made from a stretchable or compressible material, such as Spandex or Lycra® and forms a closed loop dimensioned so as to tightly encircle a person's hand. The pad 104 is attached to the inside of the strap 102 where it will be in contact with a baby or the user's body and may be covered with a section of soft material 104, such as terrycloth or fleece. In some embodiments, the band 100 may be manufactured in various diameters to fit different size hands. In another embodiment 200 (FIG. 2), the strap may be an elongated strip of material 202 having ends that are fastened together with, for example, a hook-and-loop fastener such as Velcro® material 206 to form the closed loop. A pad 204 may cover a portion of the strap 202 on the inside where it will be in contact with a baby or the user's body. FIG. 3 illustrates the band 100 (or 200) around a user's hand 10, with the soft material covering the pad 104 facing outward on the palm-side of the strap 102. If desired, the strap 102 and pad 104 may be provided in a variety of colors and patterns, adding a fashionable aspect to the band 100.

Figure 4:
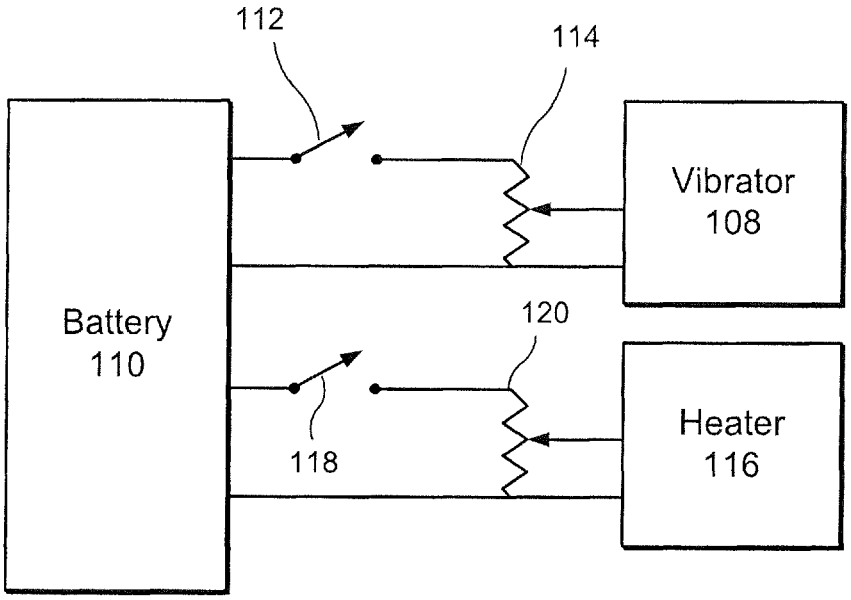
FIG. 4 illustrates a general block diagram of the electrical components of the vibrating hand band of FIG. 1 or FIG. 2.
Figure 5:
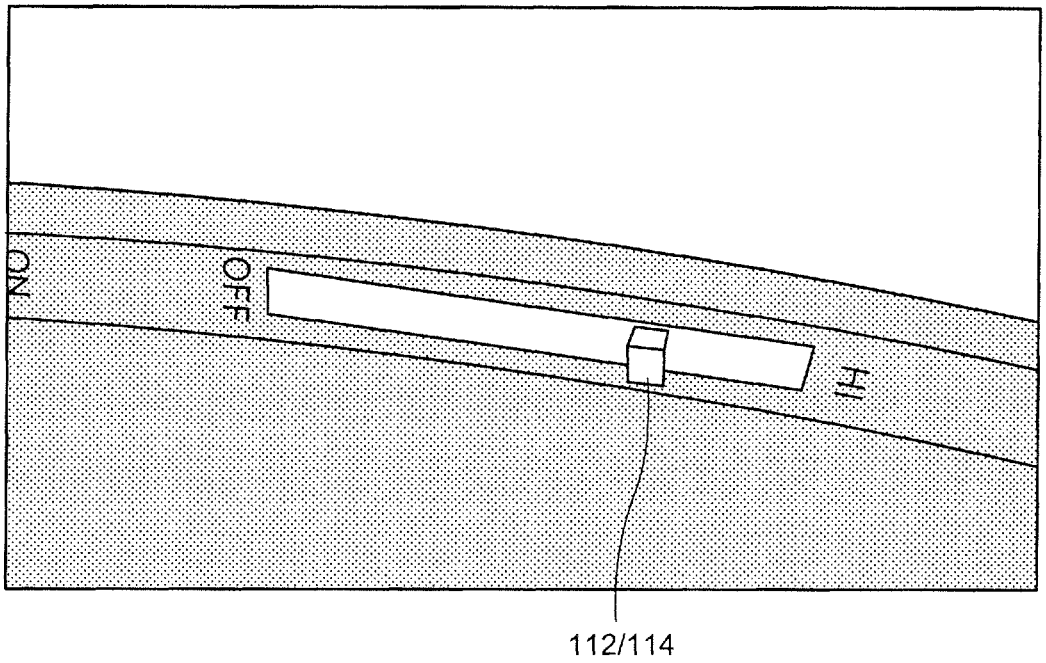
FIG. 5 illustrates a close up view of the vibration strength control which may be incorporated in the vibrating hand band of FIG. 1 or FIG. 2.

The band 100 includes a vibrating mechanism 108 (FIG. 4) that is embedded in the pad 104. The vibrating mechanism 108 may be one or more piezoelectric elements or any other suitable vibrating means. The vibrating mechanism 108 may be powered by a battery 110 which may be disposable or rechargeable. A switch 112 allows the vibrating mechanism 108 to be turned on and off. Alternatively, the vibrating mechanism 108 may be turned on and off by removing or disconnecting the battery. An optional control circuit 114 may allow the strength of the vibrations to be adjusted. The control circuit 114 may allow continuous adjustment of the strength of the vibrations or may have several discrete settings. The switch 112 and control circuit 114 may be separate or, as illustrated in FIG. 5, may be combined as a slider embedded in the side of the pad 104 (also shown in FIG. 3).

The band 100 may also include a heating element 116 that is also embedded in the pad 104 and powered by the battery 110. A switch 118 allows the heating element 116 to be turned on and off and an optional control circuit 120 allows the temperature to be adjusted. The control circuit 120 may allow continuous adjustment of the heat or may have several discrete settings. The switch 118 and control circuit 120 may be separate or may be combined as a slider embedded in the side of the band 100.

Figure 6:
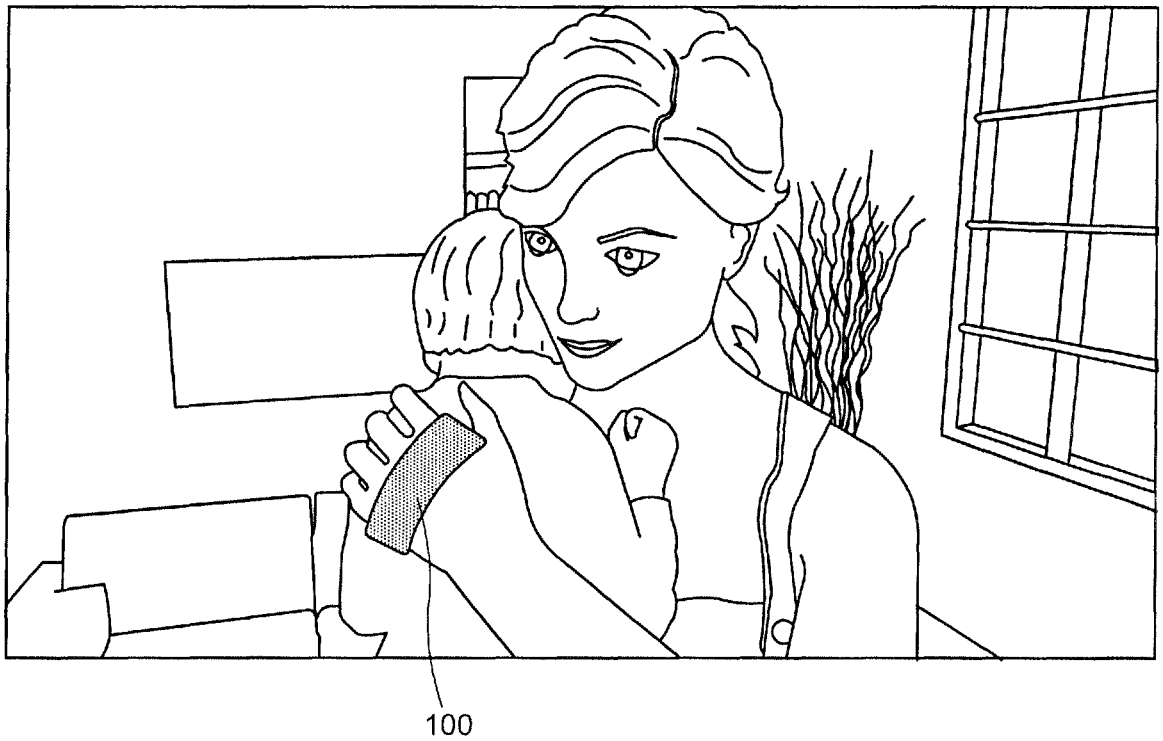
FIG. 6 illustrates the use of the vibrating hand band of FIG. 1 or FIG. 2 by a mother with a child.
Figure 7:
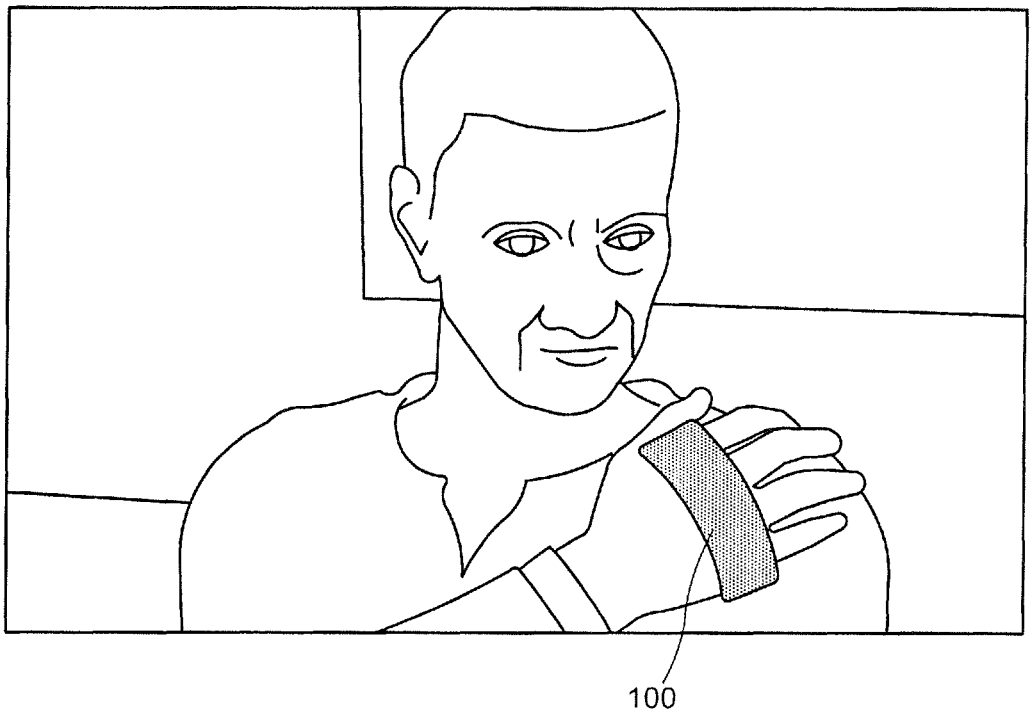
FIG. 7 illustrates the use of the vibrating hand band of FIG. 1 or FIG. 2 on a shoulder.
Figure 8:
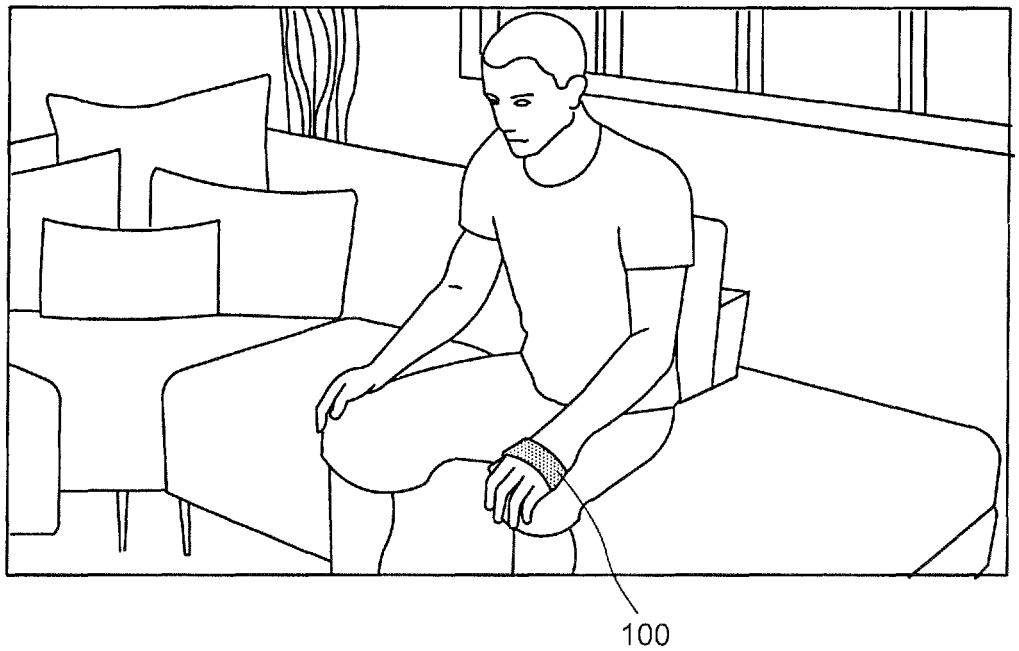
FIG. 8 illustrates the use of the vibrating hand band of FIG. 1 or FIG. 2 on a knee.

To use, the strap 102 is stretched and the four fingers of the user's hand 10 are inserted through the strap 102 (or, the strap 202 is wrapped around the user's hand and the ends secured to each other). The strap 102 is then allowed to compress back to its original size, providing a tight fit around the palm and back of the hand 10. The band 100 is turned so that the pad 104 is against the palm of the hand 10. The vibrating mechanism 108 is turned on with the switch 112 and the strength of vibrations is adjusted with the control circuit 114 (if used). If incorporated into the band 100, the heating element 116 may be turned on with the switch 118 and the temperature may be adjusted with the control circuit 120. The vibrating band 100 may then be used to comfort a baby by merely resting the hand 10 with the pad 104 on the baby, such as on his or her stomach or back. As illustrated in FIG. 6, use of the band 100 to comfort a baby allows the caregiver to hold the baby in a normal position, enhancing the bond between them, and easily move his or her hand 10 to different locations on the baby's body. In a similar manner, the band 100 may also be used to relieve pain and stiffness of joints and muscles, such as the user's shoulder (FIG. 7) or knee (FIG. 8), back, calves, or other location on the body.

Having an open strap 102, 202, the band 100 allows full use of the user's thumb and fingers for adjusting the vibration and heat settings as well as to provide maximum contact with the baby. Further, the band 100 is compact and foldable, enabling it to be easily stored or carried for travel. The vibrating mechanism 108 and heating element 116 are quiet enough that the band 100 may be used in any setting.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A vibrating hand band, comprising:

a closed loop strap of a stretchable material dimensioned to encircle a user's hand;

a pad secured to a portion of the strap;

a vibrating mechanism embedded in the pad, wherein the vibrating mechanism is completely surrounded by the pad and, wherein the pad including the vibrating mechanism is configured to be placed over a palm of the user when the vibrating hand band is in an operable position such that fingers of the user are free when in the operable position; and a power supply to provide power to the vibrating mechanism.

2. The vibrating hand band of claim 1, wherein the strap comprises an elongated strip of material having ends that are fastenable to each other to form the closed loop.

3. The vibrating hand band of claim 2, wherein the ends of the elongated strip comprise hook-and-loop material.

4. The vibrating hand band of claim 1, further comprising a first user-operated control circuit configured to adjust strength of vibrations from the vibrating mechanism, the first user-operated control circuit having a first position in which the vibrating mechanism is off, a second position in which the vibrating mechanism is operating at maximum strength and at least one third position in which the vibrating mechanism is between Wand maximum strength.

5. The vibrating hand band of claim 1, further comprising an electrical heating element embedded in the pad.

6. The vibrating hand band of claim 5, further comprising a second control circuit configured to adjust temperature of the heating element, the second user-operated control circuit having a first position in which the heating element is off, a second position in which the heating element is operating at maximum heat and at least one third position in which the heating element is between off and maximum heat.

7. The vibrating hand band of claim 1, further comprising a soft material covering at least a portion of the pad.

8. The vibrating hand band of claim 1, wherein the strap has a width between about 1 inch to about 1½ inches.

9. The vibrating hand band of claim 1, wherein the pad has a width of about 2 inches.

10. The vibrating hand band of claim 1, wherein the vibrating mechanism comprises at least one piezoelectric element.

11. The vibrating hand band of claim 4, wherein the first, second and third positions of the first user-operated control circuit comprise three discrete settings.

12. The vibrating hand band of claim 4, wherein the first user-operated control circuit is configured for a continuous range of adjustments of a strength of vibration between the first and second positions.

13. The vibrating hand band of claim 4, wherein the first user-operated control circuit is located on one of the closed loop strap or pad such that the first user-operated control circuit is configured to be operated by at least one of the user's free fingers when the vibrating hand band is in the operable position.

14. The vibrating hand band of claim 6, wherein the first, second and third positions of the second user-operated control circuit comprise three discrete settings.

15. The vibrating hand band of claim 6, wherein the second user-operated control circuit is configured for a continuous range of adjustments of heat between the first and second positions.

16. An apparatus, comprising:

a strap;

a pad coupled to the strap, wherein the pad, when in an operable position, is configured to be placed over a palm of a user such that fingers of the user are free when in the operable position; and a vibrating mechanism embedded in and completely surrounded by the pad; and a power supply to provide power to the vibrating mechanism.

* * * * *